United States Patent [19]

Gautier

[11] Patent Number: 4,896,033

[45] Date of Patent: Jan. 23, 1990

[54] ARRAY OF OPTICALLY-CONTROLLED ELEMENTS FOR THE DIFFUSION OF ELECTROMAGNETIC ENERGY

[75] Inventor: Francois Gautier, Germain En Laye, France

[73] Assignee: Thomson-CSF, Paris, France

[21] Appl. No.: 298,268

[22] Filed: Jan. 17, 1989

Related U.S. Application Data

[63] Continuation of Ser. No. 39,690, Apr. 20, 1987, abandoned.

[30] Foreign Application Priority Data

Apr. 22, 1986 [FR] France ..... 86 05803

[51] Int. Cl.[4] ..... H01J 40/14

[52] U.S. Cl. ..... 250/215; 343/754

[58] Field of Search ..... 250/201, 215; 343/762, 343/754; 332/3; 378/119; 455/607

[56] References Cited

U.S. PATENT DOCUMENTS

| | | | |
|---|---|---|---|
| 3,222,601 | 12/1965 | Sartorio et al. | 343/762 |
| 4,507,662 | 3/1985 | Rottenberg et al. | 343/754 |
| 4,552,151 | 11/1985 | Bolomey et al. | 343/754 |

OTHER PUBLICATIONS

IEEE Transactions On Microwave Theory And Techniques, vol. MTT-29, No. 11, Nov. 1981, pp. 1225-1231, IEEE, N.Y., U.S.; R. J. King et al.; "Probing Amplitude, Phase, and Polarization of Microwave Field Distributions in Real Time".

IEEE Transactions On Microwave Theory And Techniques, vol. 30, No. 11, Nov. 1982, pp. 1998-2000, IEEE, New York, U.S.; J. Ch. Bolomey et al.: "Microwave Diffraction Tomography For Biomedical Applications".

Patents Abstracts of Japan, vol. 6, No. 200 (E-135) [1078], 9 Oct. 1982; & JP-A-57 107 607 (Tokyo Shibaura Denki K. K.).

*Primary Examiner*—Edward P. Westin
*Assistant Examiner*—Khaled Shami
*Attorney, Agent, or Firm*—Oblon, Spivak, McClelland, Maier & Neustadt

[57] ABSTRACT

The main object of the invention is an array of optically-controlled elements for the diffusion of electromagnetic energy. The invention pertains to an array capable of diffracting the electromagnetic energy which illuminates it, certain elements of the said array being capable of modulation. The device according to the invention comprises photodetectors which can be used for the optical modulation of the emitting/reflecting elements, whether diffusing or diffracting. The optical modulation provides for the individual control of each radiating element up to very high frequencies. Furthermore, the device according to the invention can be used to reduce the complexity of an array by doing away with the control wiring. The invention can be applied chiefly to the making of radar-testing devices, for example the simulation of bright points, the ultra-high-frequency tomography of the human body and the making of beacons.

9 Claims, 3 Drawing Sheets

ARRAY OF OPTICALLY-CONTROLLED ELEMENTS FOR THE DIFFUSION OF ELECTROMAGNETIC ENERGY

This application is a continuation of application Ser. No. 039,690, filed on Apr. 20, 1987, now abandoned.

BACKGROUND OF THE INVENTION (1) Field of the Invention

The main object of the invention is an array of optically-controlled elements for the diffusion of electromagnetic energy.

The object of the invention is also an array providing for the diffusion of ultra-high frequency energy in a near field. In the prior art, controllable, diffusing arrays are made with radiating element charged by variable impedances. For example, electronically-controlled diodes are used. In the absence of any control signal, an electromagnetic wave illuminating the array is reflected and/or diffused without any change in frequency.

A modulated state of the array is obtained by modulating the impedance of the charges at a frequency $f_m$ of one or more elements of the array.

In a first example, the modulation of certain diffusing elements is a phase modulation. In this case, a frequency wave $f_0$ illuminating the array will be diffused with a spectrum of lines and the frequency will be equal to $f_0+kf_m$, k being an integer.

In a second example, the modulation is a pure amplitude modulation. In this case, the waves diffused by the array comprise, in addition to the spectral line at the frequency $f_0$, the spectral line $f_0+f_m$ as well as the spectral line corresponding to the frequency $f_0-f_m$.

(2) Description of the Prior Art

The device of the prior art comprises an electrical control for the modulation of diodes organized in matrix form. A device of this type is described in the French patent No. 81 09855. A diode, for example the diode at the intersection of the row I and the column J, is controlled by receiving a signal simultaneously at the row I and the column J. Thus the device very greatly reduces the number of connections needed.

Devices of the prior art have disadvantages. Firstly, the matrix-based control system prevents the possibility of having individual controls for several diodes.

Secondly, the length of the modulation current input lines prevents the obtaining of high-frequency modulations for large-sized panels. For example, it is practically impossible to exceed 100 MHz for panels with areas of more than one square meter.

Furthermore, it is extremely difficult to build modulation circuits: making such circuits means that it should be possible to supply power to any one of the columns and rows. It is therefore necessary to make a branching device comprising several outputs. For example, an array with an increment of 20 mm., with an area of 2 m. by 2 m., comprises 100 columns and 100 rows.

In the device according to the invention, each radiating element is associated with a diode, the modulation control of which is provided by a photoreceptor. To modulate a given element, a light wave is received by the photodetector which is connected to the corresponding radiating element. The light wave is emitted, for example, by laser. Power is supplied to several radiating elements simultaneously by modulating several photoreceptors with, for example, several lasers. The control of each radiating element is completely independent.

SUMMARY OF THE INVENTION

The main object of the invention is an ultra-high frequency radiating element, capable,.of being modulated at a frequency fm, comprising a photodectector capable of transforming a light signal, modulated at the frequency $f_m$, into an electric signal that controls the modulation of the radiating element.

Another object of the invention is an array of ultra-high frequency radiating elements comprising ultra-high frequency radiating elements with modulation control by light radiation.

BRIEF DESCRIPTION OF THE DRAWINGS

The invention will be better understood from the following description and figures, given as non-exhaustive examples. Of these figures:

FIGS. 1 to 7 use the same references to designate the same elements.

DESCRIPTION OF THE PREFERRED EMBODIMENT

Figure 1:
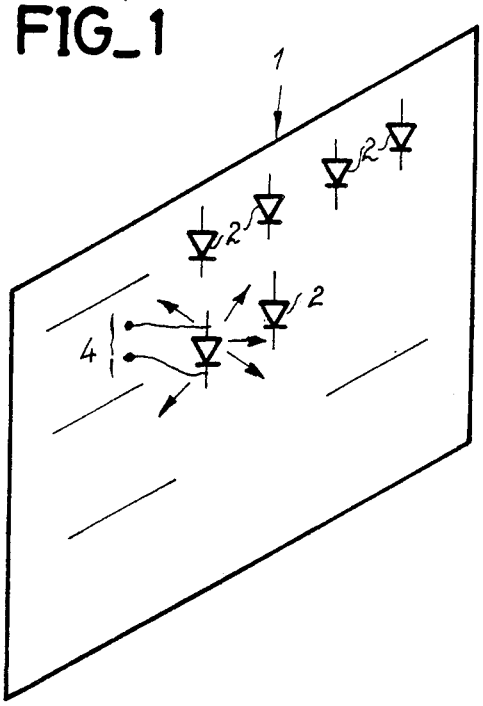
FIG. 1 is a diagram illustrating the working principle of the diffusing array.

FIG. 1 shows a diffusing array 1 comprising radiating elements charged by variable impedances. In the example illustrated in FIG. 1, the radiating elements are diodes 2. For the clarity of the figure, only 6 diodes have been depicted. Each diode 2 is capable of being powered by a current modulated at the frequency $f_m$. In FIG. 1, the modulation of the diode 2 is symbolized by two electric wires 4. When the reflecting array 1 is illuminated by a radioelectric wave, the radiating elements 2, modulated at the frequency $f_m$, diffuse the frequency waves $f_0+kfm$ omnidirectionally.

In the case of an amplitude modulation, $k=\pm 1$.

In the case of a phase modulation, k is an integer.

Figure 2:
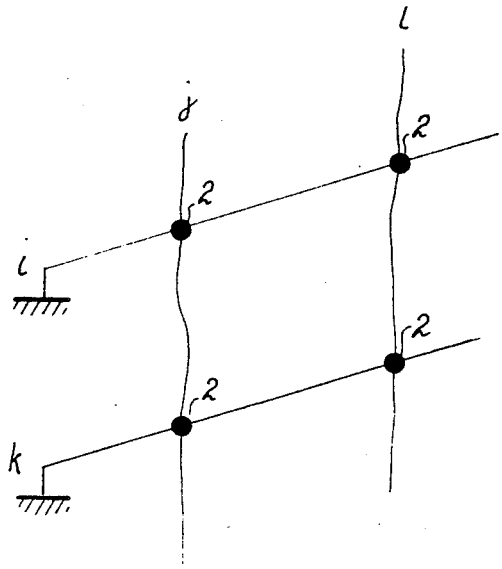
FIG. 2 is a diagram illustrating the disadvantages of the device of the prior art.

FIG. 2 shows a diagram illustrating the modulation control device for the four diodes 2 of a panel 1 of the prior art. The diodes 2 are at the intersection of the rows I and K and the columns J and L. If, for example, it is sought to modulate the diode 2 at the intersection of the row I and the column J at a frequency $f_1$, a frequency signal $f_1$ is sent to the column J and an enabling signal to the row I. If it is sought to modulate the diode at the intersection of the column L and the row K at the frequency $f_2$ a signal with a frequency $f_2$ is sent to the column L and an enabling signal to the row K. Thus, if it is sought to obtain both the above modulations simultaneously with an array of the prior art, in addition to the diode 2 which is at the intersection of the column J and the row I, which will be modulated at the frequency $f_1$, and the diode 2 at the intersection of the column L and the row K, which will be modulated at a frequency $f_2$, the diodes 2 which are at the intersection of the column L and the row I will be modulated, respectively, at the frequencies $f_1$ and $f_2$. Thus, with the devices of the prior art, it is impossible to modulate two diodes which are not in the same column. Furthermore, it is impossible to modulate two diodes belonging to one and the same column, with two different frequencies.

Figure 3:
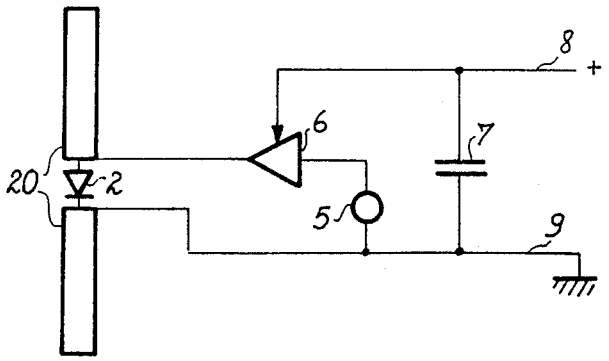
FIG. 3 is a diagram of a first example of an embodiment of radiating elements according to the invention.

FIG. 3 depicts an example of a mode of embodiment of a radiating element according to the invention. The radiating element comprises, for example, a dipole 20 between the arms of which is set a diode 2. The diode 2 is advantageously powered by an amplifier 6 controlled by a ultra-high-frequency radiation source photodetector 5 which acts as a photoelectric receiver. For example, the photodetector 5 as well as the diode 2 are linked to the ground by a row 9. The amplifier 6 is electrically powered by a row 8 linked to the + terminal of a generator which is not depicted. A second terminal of the photodetector 5 is linked to the amplifier 6. A capacitor 7 advantageously connects the power lines 8 and 9. Thus the capacitor 7 stores the electrical energy needed for supplying power to the amplifier 6 and for polarizing the diode 2. The local storage of electrical power makes it possible to deliver the electrical power needed instantaneously, and thus to achieve high frequencies.

The photodectector 5 is, for example, a photoresistor, a phototransistor or a photodiode. The sensitivity of the photodector 5 is compatible with the frequency of the carrier wave of the modulation used. The amplifier 6 is adapted to the modulation frequencies used.

Figure 4:
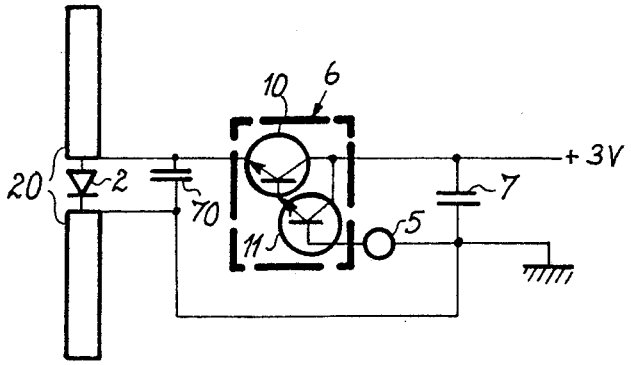
FIG. 4 is a diagram of a second alternative embodiment of a radiating element according to the invention.

FIG. 4 depicts a second mode of embodiment of a diffusing element according to the invention. In the mode of embodiment depicted in FIG. 4, the diode 2 placed between the two arms of the dipole 20 is powered by two transistors 10 and 11 controlled by the photodetector 5. The first terminal of the photodetector 5 is grounded. A second terminal of the photodetector 5 is linked to the base of the transistor 11. The emitter of the transistor 11 is linked to the base of the transistor 10. The collectors of the transistors 10 and 11 are connected to the electrical power supply (not depicted). The emitter of the transistor 10 is linked to one of the terminals of the diode 2. The generator (not depicted) maintains, for example, a potential difference of 3 volts between the positive terminal and the ground. Advantageously, a capacitor 70 is placed at the terminals of the diode 2, providing for the decoupling of the ultra-high-frequency field received and/or emitted by the dipole 20 and the diode 2.

Advantageously, a capacitor 7 is placed at the power terminals. The terminal of the diode 2 opposite to the one linked to the emitter of the transistor 10 is linked to the ground.

Figure 5:
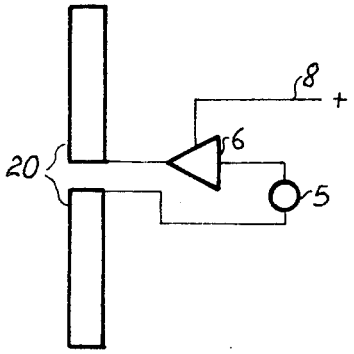
FIG. 5 is a diagram of a third example of a mode of embodiment of the device according to the invention.

FIG. 5 depicts a mode of embodiment of the device according to the invention which is capable of directly emitting modulated radiation, the modulation being emitted by optical means. The photodetector 5 is linked to two arms of the dipole 20. Advantageously, to obtain greater power, an amplifier 6 for example, powered by a line 8, is used to amplify the signal which is picked up by the photodetector 5 and sent to the dipole 20. The device of the FIG. 5 can be used to emit a modulated radiation without being illuminated by an ultra-high-frequency radiation source Thus, the device illustrated in FIG. 5 applies especially to the making of independent beacon lights without any electrical connection to an ultra-high-frequency signal generator.

In one mode of embodiment of the device according to the invention, diodes 2 are used, the ultra-high-frequency impedance variation of which is sufficient when it changes from a zero polarization voltage to a voltage of one volt. The diode has a capacity of less than 0.16 pF at 0 volts, giving 100 J ohms at 1010 Hz; a direct resistance of about 1 ohm for a voltage which is substantially equal to one volt.

In the device according to the invention, the diodes do not have to withstand power. Advantageously, therefore, the diodes chosen are adapted to high switching frequencies. For example, the diodes used are capable of commutating several hundreds of megahertz.

In a first mode of embodiment of the device according to the invention, the amplifier 6 comprises a single transistor.

In a second mode of embodiment of the device according to the invention, the amplifier 6 comprises a Darlington pair of transistors 10 and 11.

In a third mode of embodiment of the device according to the invention, an integrated amplifier is used.

The capacitor 7 can be used to instantaneously supply the necessary energy to the diodes 2. For example, for an operating time of 1 microsecond with a delivery rate of 20 mA at 3 V, it is necessary to supply a charge of $$Q=\tfrac{1}{2}10^{-6}\cdot 20\cdot 10^{-3}=10^{-8}\times C.$$

The factor 1 takes the modulation of the signal into account. So that the capacitor 7 does not discharge more than 10%, its capacity C must be equal to:

$$C=\frac{10^{-8}}{3}\times 10=0.03\ \mu\text{F}.$$

A capacitor 7 of this type is capable of supplying the 2 V needed for the operation of the amplifier 6 and the 1 V used to polarize the diode 2.

Figure 6:
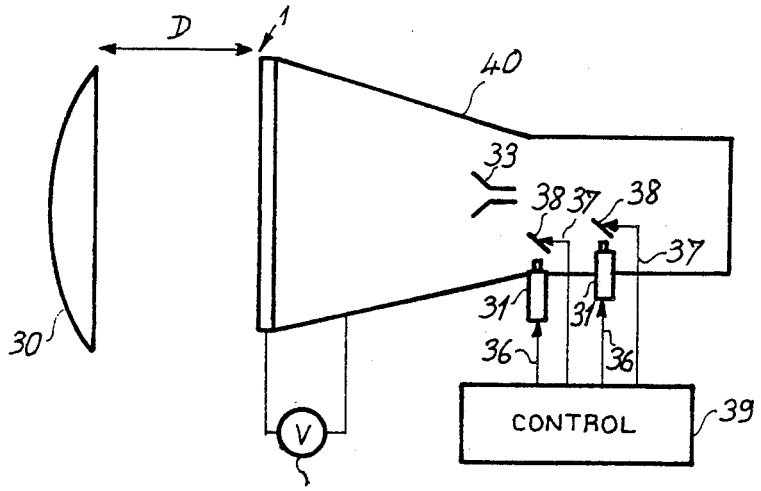
FIG. 6 is a diagram of a first example of an application of the device according to the invention.

FIG. 6 depicts a field-measuring device according to the invention The device comprises an ultra-high-frequency energy receiver 30, an array 1 with its electrical power supply 41, a control circuit 39, lasers 31 and laser-beam deflecting devices 38.

The ultra-high-frequency radiation receiver 30 is, for example, the antenna of a radar for which it is sought to test the performance. The array 1 comprises the devices illustrated in FIGS. 3 and 4, distributed at regular intervals on the surface of the array For example, the array 1 comprises 10,000 to 100,000 devices illustrated in FIG. 4. By increasing the number of devices of FIG. 4, it is possible to reduce the increment and therefore increase the resolution of the device Advantageously, the array 1 is made in the form of a printed circuit by photo-etching the radiating elements and the power lines, the active components being carried on to the said printed circuit.

Advantageously, the modulation circuits receive the supply voltage given by the generator (not shown) in parallel.

Advantageously, the power supply lines are arranged so as to minimize disturbances of the electromagnetic field. For example, the power lines are arranged perpendicularly to the electrical field of the radiation capable of illuminating the array 1. The laser or lasers 31 comprise a source of radiation, the frequency and power of which are adapted to the photodetector 5 used, a modulation device as well as a beam.-orienting device 38 For an amplitude modulation, the element used will be, for example, a Kerr cell used to modulate and interrupt the light emission. The beam-orienting device 38 comprises, for example, movable mirrors and servomechanisms In one alternative mode of embodiment, the beam-orienting device comprises variable-index electronic devices The lasers 31 and the beam-orienting device 38 are controlled by a control device 39. The control device 39 supplies each laser 31, through a line 36, with the signal modulated at the frequency $f_m$ providing for the modulation of the laser beam at the desired frequency. The orientation of the beam is controlled by lines 37 which link the control circuit 39 to the beam-orienting device 38 Only two lasers 31 have been shown in FIG. 6. It is clearly understood that the use of a larger number of lasers is not outside the scope of the present invention.

In one alternative mode of embodiment according to the invention, a single laser is used to modulate several diodes 2, the beam-orienting device 38 being used to successively illuminate these diodes, with the modulation cell stopping the beam before the point age is established.

Advantageously, the array 1 is enclosed in a chamber 40 that absorbs light radiation capable of exciting the photodetectors 5 and/or the ultra-high-frequency radiation.

In a first alternative mode of embodiment, the antenna 30 for which it is sought to measure the performance, illuminates the array 1 according to the invention and measures the field reflected by the said arrays.

In another alternative mode of embodiment of the device according to the invention, the array 1 is illuminated by an ultra-high-frequency radiation source 33, the antenna 30 analyzing the field emitted by the array 1. The antenna 30 has a diagram suited to the geometry of the array 1. The ultra-high-frequency radiation source 33 emits the frequency $f_0$, the spectrum of which has the purity needed for the functioning of the receiver connected to the antenna 30.

In a first alternative mode of embodiment of the device according to the invention, the ultra-high-frequency radiation source 33 permanently illuminates the entire reflecting array 1.

In a second alternative mode of embodiment of the device according to the invention, the radiation source 33 illuminates only the zone or zones of the array 1 where the modulation is applied. The scanning is obtained either by pointing the radiation source 33 mechanically or by electronic scanning.

Figure 7:
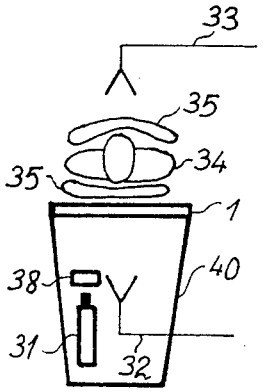
FIG. 7 is a diagram of a second example of an application of the device according to the invention.

FIG. 7 depicts a device for the ultra-high-frequency tomography of the human body A patient 34 is illuminated by ultra-high-frequency energy by means of an radiation source 33. An array 1 according to the invention, associated with a laser 31 and beam-deflecting devices 38, is used to analyze the fields emitted by the body of the patient 34. The field emitted, for example inside a chamber 40, is picked up by a receiver antenna 32. Advantageously, water bags 35 are provided above and below the patient 34, providing for a more efficient adaptation of the ultra-high-frequency energy.

We can assess the power received by the antenna 30 by a simple test.

Take a wave with a power of $P_0$ illuminating an array with an area S comprising elements for which the pick-up area is s.

Assuming an efficiency of 50% between the illuminator and the illumination of the array, the power picked up by each element is:

$$P_e = \frac{sP_e}{S\,2}$$

The efficiency of the modulation depends considerably on the modulation frequency and the characteristics of the charging diode 2. We shall take an efficiency of 1% as a typical value.

The diffracted power is then:

$$P_d = \frac{1}{200}\ \frac{s}{S}\ P_0.$$

With a gain of the element equal, at an initial approximation, to $4\pi s/\lambda 2$, the power received by a radar antenna 30 with a gain G located at a distance D is:

$$P_r = G \cdot \frac{4\pi s}{\lambda^2}\ \frac{\lambda^2}{(4\pi D)^2}\ \frac{1}{200}\ \frac{s}{S}\ P_0$$

Giving:

$$P_r = \frac{G}{800\pi D^2}\ \frac{s^2}{S}\ P_0$$

For example, for:
$P_0 = 10$ W
$S = 10$ m$^2$
$s = 10$ cm$^2$
$D = 10$ m
$G = 30$ dB
We get:
$P_d = 5\ \mu$w
and
$P_r = 4\ \mu$w giving—54 dBm.

The device of the present invention is applicable chiefly to the measurement of electromagnetic fields, the simulation of bright points for radar antenna testing, the building of beacons and the tomography of the human body using ultra-high frequencies.

What is claimed is:

1. A network for the controlled diffusion of electromagnetic energy, said network receiving a radioelectric wave of frequency $f_o$ from a first outside source and receiving a modulated light ray from a second outside source, said network comprising:

photodetector means for receiving said light ray and converting said light ray to an electrical signal of frequency $f_m$;

a dipole;

a variable capacity diode connected between the two respective parts of said dipole;

means for controlling the polarization of the variable capacity diode; and wherein said dipole receives said radioelectric wave of frequency of and said electric signal of fre- of frequency $f_o$ and said electric signal of frequency $f = f_o + Kf_m$ is diffused from said dipole and said variable capacity diode omnidirectionally.

2. An array for the controlled diffusion of electromagnetic energy, said array comprising a plurality of networks, each network of said plurality of networks receiving a radioelectric wave of frequency $f_o$ from a first outside source and receiving a modulated light ray from a second outside source, each network comprising:

photodetector means for receiving said light ray and converting said light ray to an electrical signal of frequency $f_m$;

a dipole;

a variable capacity diode connected between the two respective parts of said dipole;

means for controlling the polarization of the variable capacity diode; and wherein said dipole receives said radioelectric wave of frequency $f_o$ and said electric signal of frequency $f_m$ such that a modulated signal of frequency $f=f_o+Kf_m$ is diffused from said dipole and said variable capacity diode omnidirectionally.

3. An array according to claim 2, further comprising:

amplification means, for amplification of said electrical signal $f_m$, coupled to said dipole.

4. An array according to claim 2, further comprising:

a chamber enclosing said array;

at least one laser located in said chamber;

a laser beam defining device to direct the modulated light ray from said at least one laser to the photodetector means; and a control circuit connected to said at least one laser and said deflecting device, said control circuit controlling the frequency of said modulated light ray and properly orienting the laser beam deflecting device.

5. A network according to claim 1, wherein: when K equals $\pm 1$, amplitude modulation occurs.

6. A network according to claim 1, wherein:

when K is an integer, phase modulation occurs.

7. A network according to claim 1, further comprising:

amplification means connected to said photodetector means and said dipole.

8. A network according to claim 7, wherein:

said amplification means is a Darlington pair of transistors.

9. A network according to claim 1, wherein:

the electromagnetic energy is ultra-high frequency energy.

* * * * *